US006544363B1

(12) United States Patent
Erickson

(10) Patent No.: US 6,544,363 B1
(45) Date of Patent: Apr. 8, 2003

(54) NON-TOXIC, HEAVY-METAL-FREE SHOTSHELL PRIMER MIX

(75) Inventor: Jack A. Erickson, Andover, MN (US)

(73) Assignee: Federal Cartridge Company, Anoka, MN (US)

( * ) Notice: Subject to any disclaimer, the term of this patent is extended or adjusted under 35 U.S.C. 154(b) by 242 days.

(21) Appl. No.: 09/702,120

(22) Filed: Oct. 30, 2000

(51) Int. Cl.[7] ..... C06B 33/08; C06B 33/04; C06B 31/02; C06B 31/12

(52) U.S. Cl. ..... 149/38; 149/43; 149/61; 149/62; 149/63

(58) Field of Search ..... 149/37, 38, 43, 149/61, 62, 63

(56) References Cited

U.S. PATENT DOCUMENTS

| | | | | |
|---|---|---|---|---|
| 2,009,556 A | | 7/1935 | McNutt | |
| 3,420,137 A | | 1/1969 | Staba | |
| 3,423,259 A | | 1/1969 | Staba | |
| 3,499,386 A | | 3/1970 | Stadler et al. | |
| 3,707,411 A | | 12/1972 | Gawlick et al. | |
| 4,363,679 A | | 12/1982 | Hagel et al. | |
| 4,581,082 A | | 4/1986 | Hagel et al. | |
| 4,608,102 A | | 8/1986 | Krampen et al. | |
| 4,674,409 A | | 6/1987 | Lopata et al. | |
| 4,675,059 A | | 6/1987 | Mei | |
| 4,689,185 A | | 8/1987 | Lopata et al. | |
| 4,963,201 A | | 10/1990 | Bjerke et al. | |
| 5,167,736 A | | 12/1992 | Mei et al. | |
| 5,216,199 A | | 6/1993 | Bjerke et al. | |
| 5,353,707 A | | 10/1994 | Duguet | |
| 5,388,519 A | | 2/1995 | Guindon et al. | |
| 5,417,160 A | | 5/1995 | Mei et al. | |
| 5,466,315 A | | 11/1995 | Erickson et al. | |
| 5,538,569 A | | 7/1996 | Carter | |
| 5,547,528 A | | 8/1996 | Erickson et al. | |
| 5,567,252 A | * | 10/1996 | Mei et al. | 149/22 |
| 5,610,367 A | | 3/1997 | Erickson et al. | |
| 5,831,208 A | | 11/1998 | Erickson | |
| 5,993,577 A | | 11/1999 | Erickson et al. | |
| 6,478,903 B1 | * | 11/2002 | John, Jr. et al. | 149/18 |

* cited by examiner

*Primary Examiner*—Charles T. Jordan
*Assistant Examiner*—Aileen B. Felton
(74) *Attorney, Agent, or Firm*—Schroeder & Seigfreid, P.A.

(57) ABSTRACT

A non-toxic heavy-metal-free priming mix and a method of forming same, designed especially for industrial shotshells and other shotshells having abnormally heavy charges of propellant in an effort to qualify for heavy duty assignments such as the need to break up cement which has set up within a cement kiln and impedes the operation of the kiln. The mix is characterized by the inclusion of a secondary highly shock-sensitive explosive, PETN, in unusually large amounts such as 13–17% by weight of the mix as well as equally large amounts of powdered aluminum, as a fuel. This combination, supported by potassium nitrate and ferric oxide as primary and secondary oxidizers, respectively, proves to be highly effective. Each of the components, namely DDNP, PETN, tetracene, glass, powdered aluminum, potassium nitrate, ferric oxide, and gum tragacanth is non-toxic and heavy-metal-free. The unusual combination of PETN and powdered aluminum as components, in the unusually large percentages thereof, generate unusual quantities of energy which makes a shotshell loaded with same, inherently effective in adequately firing unusually heavy loads (slugs), which will accomplish such difficult tasks effectively.

48 Claims, No Drawings

NON-TOXIC, HEAVY-METAL-FREE SHOTSHELL PRIMER MIX

BACKGROUND OF THE INVENTION

Various industrial plants present unique problems against continuous operation as a consequence of objectionable build-up of materials within the confined interiors of the manufacturing premises. For example, in the operation of cement kilns, objectionable cement stalactite-like formations build up within the interior of the kiln. Operators of such kilns resort to the use of 8-gauge shotgun slugs, which are unusually heavy loads, to dislodge such formations. Such heavy loads require the use of unusually large quantities of propellant in the shotshell. Such unusually large quantities of propellant, in turn, require increased primer ignition capability.

For many years, small arms ammunition primers have been made by using a heavy metal organic explosive as the main explosive component, with a heavy metal oxidizer and fuel. However, since 1985, there has been a growing interest in heavy-metal-free primers for environmental and personal health reasons.

Several centerfire and rimfire primer mix formulations that are heavy-metal-free and toxic metal free have been patented. However, there have not been any heavy-metal and toxic metal free primer mixes designed especially for shotshells. This may be because shotguns are normally fired out of doors and not used for indoor range shooting and hence there has not been a demand for such a product. In any event, I am not aware of any heavy-metal-free primer mix for shotshells.

It is noteworthy that a shotshell primer requires much more energy as propellant-igniting ability than a centerfire rifle or pistol primer, especially for heavy 3½" 12 gauge, 10 gauge and 8 gauge loads.

It is common practice today, however, to utilize antimony sulfide as the fuel, and barium nitrate as the oxidizer, in the priming mix needed to adequately burn the propellant. While these materials perform adequately to dislodge the objectionable accumulations of cement, etc., they produce toxic exhaust vapors which are highly objectionable. The invention herein is directed toward obviating the presence of such toxic vapors. To the best of my knowledge, no one has heretofore designed a non-toxic, heavy-metal-free primer mix for heavily loaded shotshells.

My new primer mix is both non-toxic and heavy-metal-free and is equally adequate (as compare to the above toxic primer) in supporting the burn of the increased volumes of propellant. Since it does not include any of the various lead, barium, or antimony compounds, my new primer mix is substantially more preferable over that in common use today.

BRIEF SUMMARY OF THE INVENTION

My new non-toxic heavy-metal-free primer mix is designed for effective use in heavy-load shotshells in which the slug (load) is unusually heavy, because the work which it will be called upon to do is unusually difficult.

The method of blending the components of the above mix and their specific amounts are set forth in detail hereinafter. The mix is characterized by the use of a percussion-sensitive organic primary explosive in combination with a secondary explosive such as highly shock sensitive PETN and powdered aluminum, the latter two in about equal amounts which are substantially greater than those ordinarily utilized in primers. Tetracene is used as a sensitizer, fine glass as a frictionator, and potassium nitrate and ferric oxide as oxidizers. The method of blending these components is set forth in detail hereinafter.

The inventions include the use of DDNP as the primary explosive, together with about one-half as much by weight of PETN, and powdered aluminum in an amount by weight about equal to that of the PETN.

A more detailed description of the components, together with the ranges of their amounts is comprised of about 22–32% by weight of DDNP; 3–5% by weight of tetracene; 13–17% by weight of powdered aluminum; 13–17% by weight of PETN; 8–12% by weight of fine glass; 15–19% by weight of potassium nitrate; 8–12% by weight of ferric oxide; and about 1% by weight of gum tragacanth.

DETAILED DESCRIPTION OF THE INVENTION

An example and description of the method of blending the components of my new primer mix which is non-toxic and heavy-metal-free, and is suitable for effective use in heavy-load shotshells, can best be defined as follows:

For a two-pound batch, the following materials are weighed out as "dry" materials as follows:

| | |
|---|---|
| Powdered Aluminum | 136.20 grams |
| Potassium Nitrate | 172.52 grams |
| Fine Ground Glass | 90.80 grams |
| Ferric Oxide | 90.80 grams |
| Gum Tragacanth | 9.08 grams |

The above "dry" materials are blended together until they form a homogeneous mixture.

Next the "wet" materials are weighed out in the amounts listed below:

| | | | |
|---|---|---|---|
| Diazodinitrophenol (DDNP) | 236 gm (dry) | or | 347 gm (wet wt) |
| Tetracene | 36.32 gm (dry) | or | 48.42 gm (wet wt) |
| PETN (pentaerythritol tetranitrate) | 136.2 gm (dry) | or | 197.4 gm (wet wt) |

The above three (3) wet are then blended together until the individual components cannot be distinguished. Then, the "dry blend" is added and all are mixed until the priming material again appears to be completely homogeneous. Water may be added, if the material is too dry to have the required consistency. The material is then ready to be charged into individual pellets and assembled into shotshell primers as desired.

The preferred quantities of the above components are as follows:

| | |
|---|---|
| DDNP | 26% by weight |
| PETN | 15% by weight |
| Powdered Aluminum | 15% by weight |
| Tetracene | 4% by weight |
| Fine Ground Glass | 10% by weight |
| Potassium Nitrate | 19% by weight |
| Ferric Oxide | 10% by weight |
| Gum Tragacanth | 1% by weight |

The preferred ranges of amounts by weight of the above components are:

| | |
|---|---|
| DDNP | 22–30% by weight |
| PETN | 13–17% by weight |
| Powdered Aluminum | 13–17% by weight |
| Tetracene | 3–5% by weight |
| Fine Ground Glass | 8–12% by weight |
| Potassium Nitrate | 15–19% by weight |
| Ferric Oxide | 8–12% by weight |
| Gum Tragacanth | .25–1.25% by weight |

The DDNP functions as the primary explosive, while the PETN functions as a secondary explosive. The tetracene acts as a sensitizer of the DDNP. The fine ground glass is the frictionator. The potassium nitrate is the primary oxidizer and the ferric oxide is a secondary oxidizer which also is used to slow down the rate of primer ignition. The gun tragacath functions as a binder.

The fact that, in accordance with the invention, this new primer mix is both non-toxic and heavy-metal-free makes the mix more desirable and valuable. It will be seen that this mix is at least equally as effective in use as the prior art shotshells, which utilize lead styphanate as the primary explosive.

It will also be noted that the mix employs equal quantities by weight of PETN and powdered aluminum, and that together these two components are roughly equal in weight to that of the primary explosive, DDNP. Note also that the primary oxidizer, namely potassium nitrate, exceeds in weight the weight of the secondary oxidizer, and that the weight of the fine ground glass equals that of the secondary oxidizer, ferric oxide. It should also be noted that the primary fuel is powdered aluminum, since the powdered form is most effective as a fuel. Also, the amount of PETN is about 58% by weight of the amount of the primary explosive, DDNP.

As will be seen from the above, this new mix utilizes unusually large quantities of PETN and powdered aluminum, in contrast to prior art mixes which heretofore have used much smaller quantities, probably because of the highly shock-sensitive qualities of PETN. I have utilized ferric oxide as a secondary oxidizer to slow down or dampen the shock-sensitivity of PETN, to thereby permit use of larger quantities of PETN as a secondary explosive It will, of course, be understood that various changes may be made in the form, details, arrangement and proportions of the parts without departing from the scope of the invention which comprises the matter shown and described herein and set forth in the appended claims.

What is claimed is:

1. A non-toxic heavy-metal-free primer mix suitable for effective use in heavy-load shotshells comprising:

(a) a percussion-sensitive organic primary explosive consisting of DDNP in an amount of 22–30% by weight;

(b) tetracene in an amount of 3–5% by weight;

(c) powdered aluminum in an amount of 13–17% by weight;

(d) PETN, a secondary highly shock-sensitive organic explosive, in an amount of 13–17% by weight;

(e) fine glass in an amount of 8–12% by weight;

(f) a primary oxidizer in the form of potassium nitrate in an amount of about 15–19% by weight; and (g) a secondary oxidizer in the form of ferric oxide in an amount of about 8–12% by weight.

2. The primer mix defined in claim 1, wherein the preferred amount of PETN is about 15% by weight.

3. The primer mix defined in claim 1, wherein the preferred amount of powdered aluminum is about 15% by weight.

4. The primer mix defined in claim 1, wherein the preferred amount of powdered aluminum and PETN is about 15% by weight for each.

5. The primer mix defined in claim 1, wherein the preferred amount of DDNP is about 26% by weight.

6. The primer mix defined in claim 1, wherein the preferred amount of tetracene is about 4% by weight.

7. The primer mix defined in claim 1, wherein the preferred amount of fine glass is about 10% by weight.

8. The primer mix defined in claim 1, wherein the preferred amount of potassium nitrate is about 19% by weight.

9. The primer mix defined in claim 1, wherein the preferred amount of ferric oxide is about 10% by weight.

10. The primer mix defined in claim 1, and gum tragacanth in an amount of about 1% by weight.

11. A non-toxic heavy-metal-free priming mix suitable for effective use in heavy-propellant-charge shotshells comprising:

(a) a percussion-sensitive organic primary explosive in an amount of about 22–30% by weight of the mix;

(b) a sensitizer for said explosive in an amount of about 3–5% by weight of the mix;

(c) a non-toxic metallic fuel in the form of powdered aluminum in an amount of about 13–17% by weight of the mix;

(d) non-toxic oxidizers in amounts of about 23–31% by weight of the mix;

(e) a secondary highly shock-sensitive organic explosive in an amount of about 13–17% by weight of the mix; and (f) a frictionator in the form of fine glass in an amount of about 8–12% by weight of the mix.

12. The priming mix defined in claim 11, wherein said secondary explosive constitutes about 15% by weight of the priming mix.

13. The priming mix defined in claim 11, wherein said powdered aluminum amounts to about 15% by weight of the priming mix.

14. The priming mix defined in claim 11, wherein said primary explosive constitutes about 26% by weight of the priming mix.

15. The priming mix defined in claim 11, wherein said oxidizers preferably consist of about 19% by weight of potassium nitrate and about 10% by weight of ferric oxide.

16. The priming mix defined in claim 11, wherein said frictionator consists of fine glass in an amount of about 10% by weight of the mix.

17. The priming mix defined in claim 11, wherein said sensitizer is preferably comprised of tetracene in an amount of about 4% by weight of the mix.

18. A non-toxic heavy-metal-free priming mix suitable for effective use in heavy-propellant-charge shotshells, comprising:

(a) a percussion-sensitive organic primary explosive;

(b) a chemical sensitizer for initiating said explosive;

(c) a non-toxic metallic fuel, in the form of powdered aluminum in an amount of about 13–17% by weight of the mix;

(d) non-toxic oxidizers in amounts of about 23–31% by weight;

(e) a secondary highly shock-sensitive organic explosive in an amount of about 13–17% by weight of the mix; and (f) a frictionator in an amount of about 8–12% by weight of the mix for mechanically activating the explosives.

19. The priming mix defined in claim 18, and gum tragacanth in the amount of about 0.25–1.25% by weight of the mix.

20. The priming mix defined in claim 18, wherein the amount of powdered aluminum is about 15% by weight of the mix.

21. The priming mix defined in claim 18, wherein the amount of said secondary explosive is about 15% by weight of the mix.

22. The priming mix defined in claim 18, wherein said oxidizers include potassium nitrate in an amount of about 15–19% by weight of the mix.

23. A non-toxic heavy-metal-free priming mix suitable for effective use in heavy-propellant-charge shotshells, comprising:

(a) a percussion-sensitive organic primary explosive in an amount of about 22–30% by weight of the mix;

(b) a sensitizer for initiating said explosive;

(c) powdered aluminum in an amount of about 13–17% by weight of the mix;

(d) a secondary highly shock-sensitive organic explosive in an amount of 13–17% by weight of the mix;

(e) a frictionator for activating said explosives; and (f) oxidizing agents in amounts adequate to provide the oxygen needed to adequately support the burning of said aluminum and said explosives.

24. The priming mix defined in claim 23, wherein the amount of said aluminum is about 15% by weight of the mix.

25. The priming mix defined in claim 23, wherein the amount of said secondary explosive is about 15% by weight of the mix.

26. A non-toxic heavy-metal-free priming mix suitable for effective use in heavy-propellant-charge shotshells, comprising:

(a) a percussion-sensitive organic primary explosive;

(b) a sensitizer for initiating said explosive;

(c) a secondary highly shock-sensitive organic explosive in an amount equal in weight to about one-half (½) of the weight of said primary explosive.

(d) powdered aluminum in an amount about equal in weight to the weight of said secondary organic explosive;

(e) a frictionator in the form of fine glass for activating said explosives; and (f) oxidizing agents in adequate amounts to provide the oxygen needed to adequately support the burning of said aluminum and said explosives.

27. The priming mix defined in claim 26, wherein the weight of said secondary explosive is slightly greater than one-half (½) the weight of said primary explosive.

28. A non-toxic heavy-metal-free priming mix suitable for effective use in heavy-propellant-charge shotshells, comprising:

(a) a percussion-sensitive organic primary explosive in an amount of about 22–30% by weight of the mix;

(b) a secondary highly shock-sensitive organic explosive in an amount of about 13–17% by weight of the mix;

(c) a sensitizer for initiating said explosives;

(d) a fuel for adequately supporting the burn of the propellant of the shotshell and of said explosives;

(e) a frictionator for activating said explosives; and (f) oxidizing agents in adequate amounts to provide the oxygen needed to adequately support the burning of said fuel and said explosives.

29. The priming mix defined in claim 28, wherein said fuel constitutes about 13–17% by weight of the mix.

30. A non-toxic heavy-metal-free priming mix suitable for effectiveness in heavy-propellant-charge shotshells, comprising:

(a) a percussion-sensitive organic primary explosive in an amount appropriate for the amount of propellant to be used in the shotshell;

(b) a sensitizer for initiating said explosive;

(c) a secondary highly shock-sensitive organic explosive in an amount of about 13–17% by weight of the mix;

(d) powdered aluminum in an amount constituting about 13–17% by weight of the mix;

(e) a frictionator for activating said explosives; and (f) oxidizing agents in adequate amounts to provide the oxygen needed to adequately support the burning of said aluminum and said explosive.

31. The priming mix defined in claim 30, wherein said primary explosive constitutes about 26% by weight of the mix.

32. The method of forming a non-toxic heavy-metal-free primer mix for effective use in heavy-load shotshells which comprises blending a mixture of:

(a) a percussion sensitive organic primary explosive in an amount of about 22–30% by weight of the mix;

(b) a secondary highly shock-sensitive organic explosive in an amount of about 13–17% by weight of the mix;

(c) powdered aluminum in an amount of about 13–17% by weight of the mix;

(d) a sensitizer for said explosives in an amount of about 3–5% by weight of the mix;

(e) a frictionator in the form of fine glass in an amount of about 8–12% by weight of the mix; and (f) non-toxic oxidizers in amounts of about 23–31% by weight of the mix.

33. The method of forming a non-toxic heavy-metal-free primer mix for effective use in heavy-load shotshells which comprises blending a mixture of:

(a) a percussion sensitive organic primary explosive;

(b) a secondary highly shock-sensitive organic explosive in an amount of about one-half (½) by weight of the amount of the primary explosive:

(c) powdered aluminum in an amount about equal by weight to that of the secondary explosive;

(d) a sensitizer for the explosives;

(e) non-toxic oxidizers in amounts of about 23–31% by weight of the mix; and (f) a frictionator.

34. The method defined in claim 33, in which the primary explosive is DDNP.

35. The method defined in claim 33, in which the secondary explosive is PETN.

36. The method defined in claim 33, in which the sensitizer is tetracene.

37. The method defined in claim 33, in which the oxidizers are potassium nitrate and ferric oxide.

38. The method defined in claim 33, in which the frictionator is fine glass.

39. The method defined in claim 33, in which the oxidizers are 15–19% by weight potassium nitrate and 8–12% by weight ferric oxide.

40. A non-toxic heavy-metal-free priming mix suitable for effectiveness in heavy-propellant-charge shotshells, comprising:

(a) a percussion sensitive organic primary explosive in an amount appropriate for burning the amount of propellant to be used in the shotshell;

(b) a sensitizer for initiating said explosive;

(c) a secondary highly-sensitive organic explosive in an amount of about ½ by weight of the primary explosive;

(d) powdered aluminum in an amount about equal to that of said secondary explosive;

(e) a frictionator for activating said explosives; and (f) oxidizing agents in adequate amounts to provide the oxygen needed to adequately support the burning of said aluminum and said explosives.

41. A non-toxic heavy-metal-free priming mix suitable for effectiveness in heavy-propellant-charge shotshells, comprising:

(a) a percussion-sensitive organic primary explosive in an amount appropriate for having the amount of propellant to be used in the shotshell;

(b) a sensitizer for initiating said explosive;

(c) a secondary highly-shock sensitive organic explosive in an amount of about 58% by weight of the amount of said primary explosive;

(d) powdered aluminum in an amount about equal by weight to the weight of said secondary explosive;

(e) a frictionator for activating said explosives; and (f) oxidizing agents in adequate amounts to provide the oxygen needed to adequately support the burning of said aluminum and said explosives.

42. The priming mix defined in claim 41, wherein the amount of said secondary explosive is slightly in excess of ½ the weight of said primary explosive.

43. The priming mix defined in claim 41, wherein said secondary explosive is comprised of PETN.

44. The priming mix defined in claim 41, wherein said frictionator consists of fine glass.

45. The priming mix defined in claim 41, wherein said sensitizer consists of tetracene.

46. The priming mix defined in claim 41, wherein said oxidizing agents are comprised of potassium nitrate and ferric oxide.

47. The priming mix defined in claim 41, wherein potassium nitrate is a primary oxidizer in the mix.

48. The priming mix defined in claim 41, wherein ferric oxide is a secondary oxidizing agent in the mix.

* * * * *